US012774136B2

(12) United States Patent
Berge

(10) Patent No.: US 12,774,136 B2
(45) Date of Patent: Oct. 27, 2026

(54) SAFETY CLOSURE

(71) Applicant: Silgan White Cap LLC, Downers Grove, IL (US)

(72) Inventor: Gary Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 123 days.

(21) Appl. No.: 18/663,967

(22) Filed: May 14, 2024

(65) Prior Publication Data

US 2024/0300708 A1 Sep. 12, 2024

Related U.S. Application Data

(63) Continuation of application No. 17/395,174, filed on Aug. 5, 2021, now Pat. No. 12,012,261, which is a continuation of application No. PCT/US2021/044281, filed on Aug. 3, 2021.

(60) Provisional application No. 63/060,814, filed on Aug. 4, 2020.

(51) Int. Cl.
*B65D 50/04* (2006.01)

(52) U.S. Cl.
CPC ..... *B65D 50/041* (2013.01)

(58) Field of Classification Search
CPC ..... B65D 2575/583; B65D 75/008; B65D 2251/0015; B65D 75/5872; B65D 85/72; B65D 50/041; B65D 75/5883; B65D 41/3409; B65D 47/0809; B65D 47/2031; B65D 2401/30
See application file for complete search history.

(56) References Cited

U.S. PATENT DOCUMENTS

| | | | | |
|---|---|---|---|---|
| 4,014,449 | A | 3/1977 | Hadley et al. | |
| 4,069,935 | A | 1/1978 | Hampel | |
| 4,095,717 | A | 6/1978 | Michaelsen | |
| 4,474,301 | A | 10/1984 | Davis | |
| 6,085,920 | A * | 7/2000 | Moretti | B65D 41/34 215/277 |
| 7,815,061 | B1 | 10/2010 | Robinson et al. | |
| 2008/0164234 | A1 | 7/2008 | Rho | |

(Continued)

FOREIGN PATENT DOCUMENTS

| | | |
|---|---|---|
| EP | 0175444 | 11/1987 |
| KR | 10-2006-0017916 | 2/2006 |

OTHER PUBLICATIONS

International Search Report and Written Opinion for International Application No. PCT/US2021/044281, dated Nov. 26, 2021, 11 pages.

*Primary Examiner* — Shawn M Braden
(74) *Attorney, Agent, or Firm* — Reinhart Boerner Van Deuren s.c.

(57) ABSTRACT

Described herein are one or more embodiments of closures with a child-resistant safety structure. A cap couples to a container neck, such as via threads. An overcap extends around the cap. A biasing element in the overcap biases the sidewalls of the overcap above the cap so that rotating the overcap does not transfer sufficient torque to the cap to also rotate the cap. When the overcap is pressed towards the container body, the sidewalls of the overcap interface with the cap, thereby providing a sufficient interface with sufficient friction to permit rotation of the overcap to translate into rotation of the cap.

20 Claims, 13 Drawing Sheets

(56) References Cited

U.S. PATENT DOCUMENTS

| | | | | |
|---|---|---|---|---|
| 2009/0014404 | A1* | 1/2009 | Russell | B65D 50/041 215/220 |
| 2010/0237072 | A1* | 9/2010 | Ahn | B65D 50/041 220/254.8 |
| 2020/0324941 | A1* | 10/2020 | Ross | B65D 41/349 |

* cited by examiner

SAFETY CLOSURE

CROSS-REFERENCE TO RELATED PATENT APPLICATION

The present application is a continuation of U.S. application Ser. No. 17/395,174, filed Aug. 5, 2021, which is a continuation of International Application No. PCT/US2021/044281, filed Aug. 3, 2021, which claims priority to and benefit from U.S. Provisional Application No. 63/060,814, filed on Aug. 4, 2020, which is incorporated herein by reference in its entirety.

BACKGROUND OF THE INVENTION

The present disclosure relates generally to the field of closures for containers. The present disclosure relates specifically to a closure for a container having a safety mechanism to more securely couple the closure to the container.

SUMMARY OF THE INVENTION

According to one embodiment of the invention, a closure includes a roll-on cap and an overcap. The roll-on cap includes a top panel, a vertical axis around which the top panel is centered, and a cylindrical wall that extends from the top panel. The cylindrical wall defines an inner surface that faces towards the vertical axis and an opposing outer surface that faces away from the vertical axis. The roll-on cap also includes an interface portion of the outer surface. The roll-on cap also includes a first diameter of the interface portion with respect to the vertical axis, the first diameter being a maximum diameter of the interface portion. The overcap is configured to be placed over the roll-on cap. The overcap includes a top panel, a cylindrical wall. The cylindrical wall extends from an outer periphery of the top panel, and the cylindrical wall defines an inner surface that faces towards the vertical axis. The overcap includes an interface portion of the inner surface, the interface portion of the overcap being configured to selectively interface with the interface portion of the cap. The overcap includes a second diameter of the interface portion with respect to the vertical axis, and the second diameter is less than the first diameter. The overcap includes a biasing element that biases the interface portion of the overcap a distance from the interface portion of the cap.

According to another embodiment of the invention, a closure combination includes a container, a roll-on cap and a cap. The container includes an internal volume of the container, a container neck that defines an opening, the opening providing fluid communication between the internal volume of the container and an exterior of the container, and a vertical axis around which the container neck is centered. The roll-on cap is rolled on to the container neck. The roll-on cap includes a top panel, a cylindrical wall that extends from the top panel, the cylindrical wall defining an inner surface that faces towards the vertical axis and an opposing outer surface that faces away from the vertical axis, an interface portion of the outer surface, and a first diameter of the interface portion with respect to the vertical axis. The first diameter is a maximum diameter of the interface portion. The overcap is configured to be placed over the roll-on cap. The overcap includes a top panel, a cylindrical wall extending from an outer periphery of the top panel, the cylindrical wall defining an inner surface that faces towards the vertical axis, an interface portion of the inner surface, the interface portion of the overcap is configured to selectively interface with the interface portion of the cap, a second diameter of the interface portion, the second diameter being less than the first diameter, and a biasing element that biases the interface portion of the overcap away from the interface portion of the cap.

According to another embodiment of the invention, a closure includes a roll-on cap and a cap. The roll-on cap includes a top panel, a vertical axis around which the top panel is centered, a cylindrical wall that extends from the top panel, the cylindrical wall defining an inner surface that faces towards the vertical axis and an opposing outer surface that faces away from the vertical axis, and an interface portion. The overcap includes a top panel, a cylindrical wall extending from an outer periphery of the top panel, the cylindrical wall defining an inner surface that faces towards the vertical axis, an interface portion, the interface portion of the overcap is configured to selectively interface with the interface portion of the cap, and a biasing element that biases the interface portion of the overcap away from the interface portion of the cap. The the overcap is configured such that rotation of the overcap only causes rotation of the cap when the interface portion of the overcap interfaces with the interface portion of the cap.

In one embodiment, a closure includes a roll-on cap and an overcap. The roll-on cap includes a top panel, a vertical axis around which the top panel is centered, a cylindrical wall that extends from the top panel, the cylindrical wall defines an inner surface that faces towards the vertical axis and an opposing outer surface that faces away from the vertical axis, an interface portion of the outer surface, and a first diameter of the interface portion, the first diameter being the maximum diameter of the interface portion. The overcap includes a top panel, a cylindrical wall extending from an outer periphery of the top panel, the cylindrical wall defining an inner surface that faces towards the vertical axis, an interface portion of the inner surface, the interface portion of the overcap being configured to selectively interface with the interface portion of the cap, a second diameter of the interface portion, the second diameter being less than the first diameter, and a biasing element that biases the interface portion of the overcap away from the interface portion of the cap. In a specific embodiment the cap includes a material that includes aluminum. In a specific embodiment, the top panel defines a disc shape, and the overcap includes a central portion that interfaces against the top panel of the cap, and the biasing element couples the central portion to the top panel of the overcap.

According to another embodiment, a combination includes a container, a roll-on cap and an overcap. The container includes an internal volume of the container, a container neck that defines an opening providing fluid communication between the internal volume of the container and an exterior of the container, and a vertical axis around which the container neck is centered. The roll-on cap is rolled on to the container neck. The roll-on cap includes a top panel, a vertical axis around which the top panel is centered, a cylindrical wall that extends from the top panel, the cylindrical wall defining an inner surface that faces towards the vertical axis and an opposing outer surface that faces away from the vertical axis, an interface portion of the outer surface, and a first diameter of the interface portion, the first diameter being the maximum diameter of the interface portion. The overcap includes a top panel, a cylindrical wall extending from an outer periphery of the top panel, the cylindrical wall defining an inner surface that faces towards the vertical axis, an interface portion of the inner surface, the interface portion of the overcap being configured to selectively interface with the interface portion of the cap, a second diameter of the interface portion, the second diameter being less than the first diameter, and a biasing element that biases the interface portion of the overcap away from the interface portion of the cap.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide further understanding, and are incorporated in, and constitute a part of this specification. The drawings illustrate one or more embodiments and together with the description serve to explain principles and operation of the various embodiments.

DETAILED DESCRIPTION

This disclosure provides a description of one or more closures with safety mechanisms to increase the difficulty in removing the closure from the container to which the closure is coupled. The one or more closures described herein may be used with roll-on pilfer proof (ROPP) caps, with metal caps, such as aluminum caps, and/or aluminum ROPP caps. The closure includes a safety mechanism to increase the difficulty of removing the closure from the container.

Figure 1:
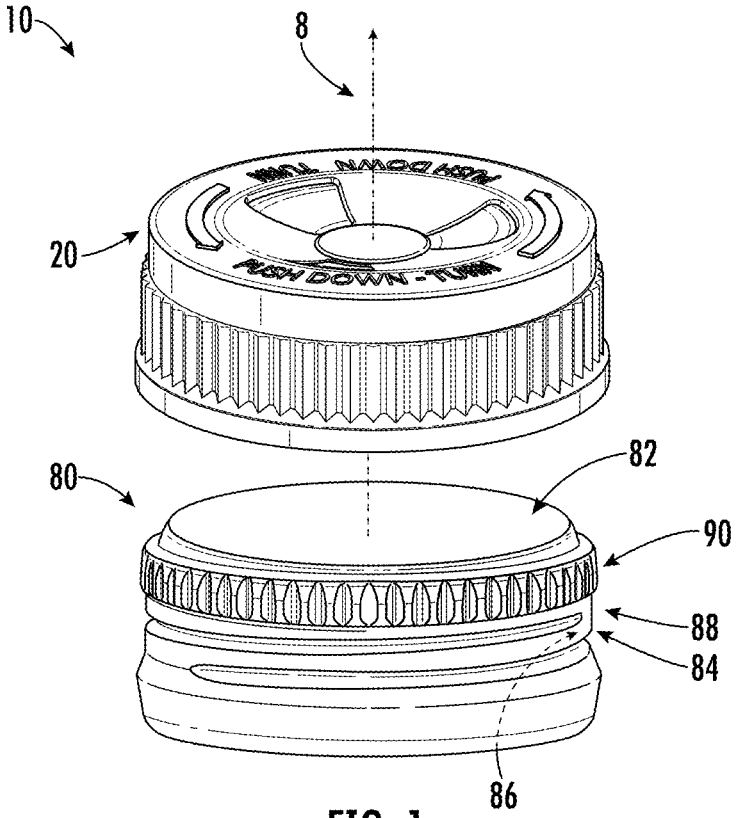
FIG. 1 is an exploded perspective view of a closure, according to an exemplary embodiment.
Figure 2:
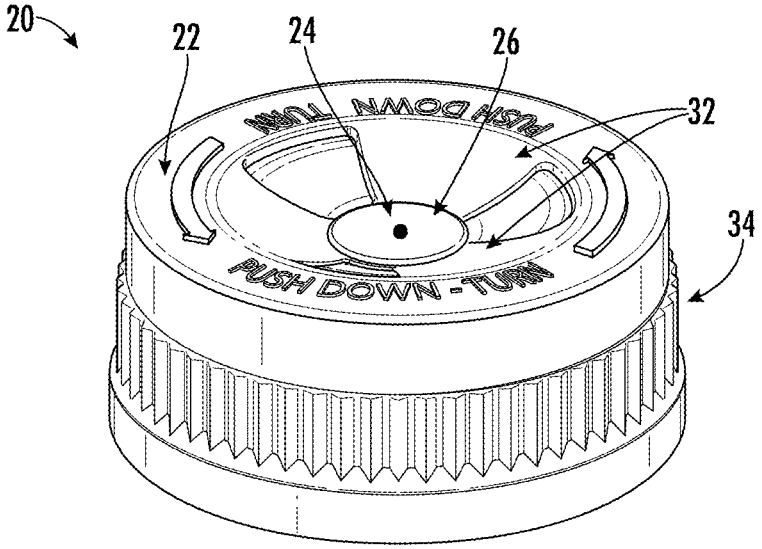
FIG. 2 is a perspective view of a portion of the closure of FIG. 1.

Turning to FIGS. 1-2, closure 10 is centered around an axis, such as a vertical axis, shown as rotational axis 8. Closure 10 includes a cap, shown as roll-on cap 80, and overcap 20. Cap 80 is coupled to a container neck, and overcap 20 is disposed over and around cap 80. In a specific embodiment, cap 80 is a roll-on pilfer proof (ROPP) cap. In a specific embodiment, cap 80 is formed from a material including aluminum, and more specifically cap 80 is an aluminum ROPP cap.

Cap 80 includes a top panel 82, which is centered around rotational axis 8. Cap 80 includes cylindrical wall 84, which extends downward from a periphery of top panel 82. Cylindrical wall 84 defines an inner surface 86, which faces towards rotational axis 8, and an opposing outer surface 88 that faces away from rotational axis 8. Outer surface 88 of cap 80 includes an interfacing portion, such as a plurality of protrusions, shown as knurls 90. In a specific embodiment, each of knurls 90 extends radially away from the rotational axis 8. In a specific embodiment, knurls 90 extend along a primary longitudinal axis 91 that extends vertically and/or is parallel to the rotational axis 8.

Overcap 20 is configured to be placed over cap 80. Overcap 20 includes a top panel 22, shown as an annular disc, and a central portion 24 coupled to top panel 22 via a biasing element, shown as arms 32. As will be described in more detail below, arms 32 bias top panel 22 to maintain a distance 58 away from (e.g., a height above) central portion 24 (e.g., an interface portion of cap 80). In a specific embodiment, the central portion 24 is a circular disc centered around center 26 (e.g., axis 8 extends through central portion 24). Central portion 24 interfaces against top panel 82 of cap 80. Cylindrical wall 34 of overcap 20 extends from an outer periphery of top panel 22 of overcap 20. Overcap 20 includes a cylindrical wall including an inner surface facing inwards towards axis 8, such as inner surface 62 of liner 50 of overcap 20. In a specific embodiment, liner 50 extends through axis 8 (e.g., liner 50 is coupled to a bottom of top panel 22 of outer portion 36).

Figure 3:
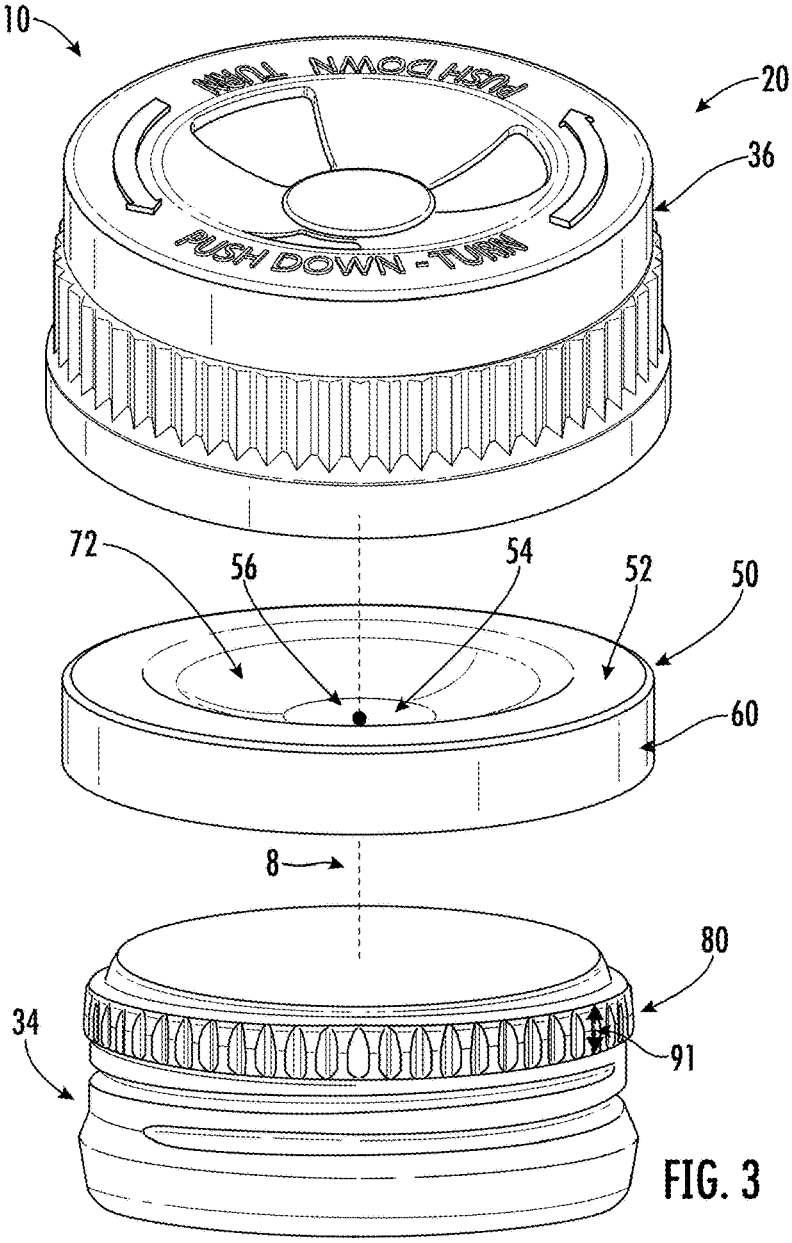
FIG. 3 is an exploded perspective view of the closure of FIG. 1.

Turning to FIG. 3, in a specific embodiment, overcap includes an inner portion, shown as liner 50, and an outer portion 36 coupled to liner 50. In another embodiment, liner 50 and outer portion 36 are formed as a single component (e.g., such as via molding and/or compression molding). In a specific embodiment, liner 50 of overcap 20 includes interface portion 64 that selectively interfaces with knurls 90 of cap 80. In a specific embodiment, liner 50 and outer portion 36 are formed from different materials, and in an alternate embodiment liner 50 and outer portion 36 are formed from the same material. In a specific embodiment, liner 50 includes a central portion, shown as circular central portion 25 of central portion 24, and outer portion 36 includes a central portion, shown as circular central portion 27 of central portion 24.

Liner 50 includes a top panel 52, shown as an annular disc, a central portion 54 coupled to the top panel 52 via biasing element 74. Central portion 54 is centered on axis 8 at center 56 (e.g., axis 8 extends through central portion 54), and central portion 54 interfaces with top panel 82 of cap 80. Cylindrical wall 60 extends from a periphery of top panel 52.

Figure 4:
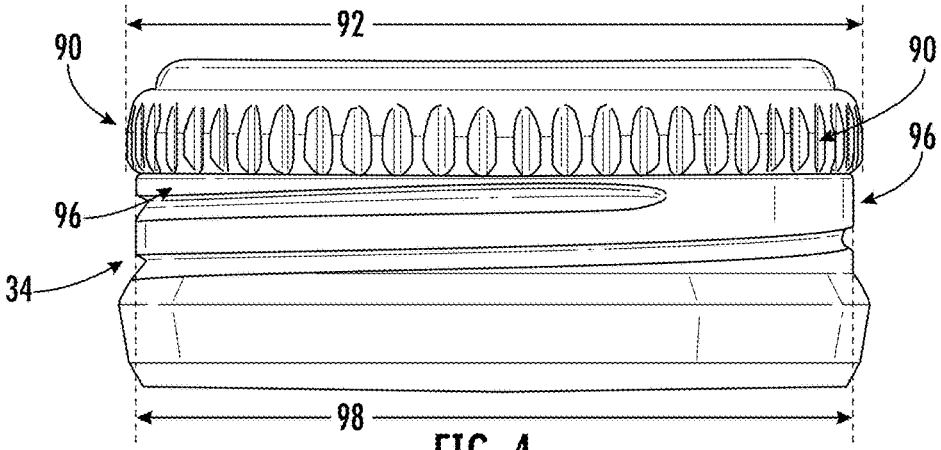
FIG. 4 is a side view of a portion of the closure of FIG. 1.

Turning to FIG. 4, various aspects of cap 80 are shown. Knurls 90 define a width, shown as diameter 92 with respect to rotational axis 8, which is the maximum diameter of knurls 90. In various embodiments, diameter 92 is the maximum diameter of cap 80. As can be seen, diameter 92 of knurls 90 is greater than diameter 98 of ledge 96 beneath knurls 90. This difference in diameters provides the structure by which a protrusion, shown as ledge 30, extends inwardly towards axis 8 and thereby secures overcap 20 to cap 80 by interfacing with knurls 90, such as a lower end 93 of knurls 90.

Figure 5:
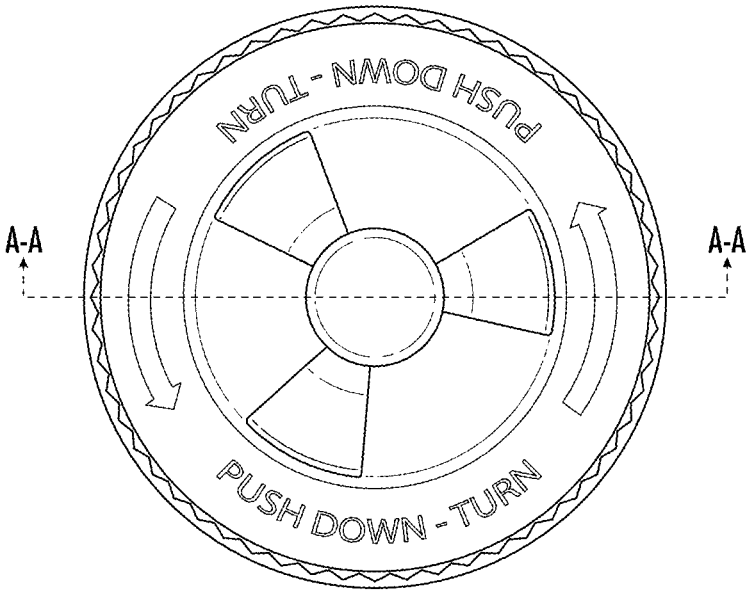
FIG. 5 is a top view of the closure of FIG. 1.
Figure 6:
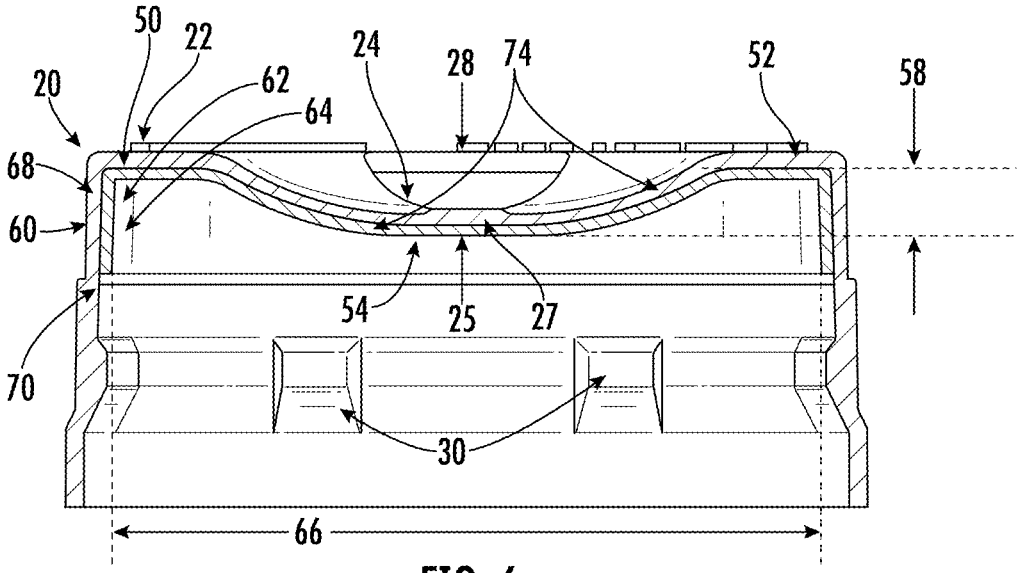
FIG. 6 is a cross-sectional view of a portion of the closure of FIG. 5 taken along the line A-A in FIG. 5.

Turning to FIGS. 5-6, various aspects of overcap 20 and liner 50 are shown. Liner 50 incudes cylindrical wall 60, which extends from a periphery of liner 50. Cylindrical wall 60 defines inner surface 62, which faces towards axis 8, and opposing outer surface 68, which faces away from axis 8. Inner surface 62 of liner 50 includes interfacing portion 64, which has a diameter 66. As will be described in more detail below, interfacing portion 64 of liner 50 is configured to selectively interface with knurls 90 of cap 80 to translate the rotation of overcap 20 and liner 50 into torque and corresponding rotation of cap 80. In various embodiments, diameter 66 of interface portion 64 is less than diameter 92 of knurls 90. In various embodiments, arm 32 of overcap 20 biases interfacing portion 64 of liner 50 of overcap 20 a distance 72 from knurls 90 of cap 80. In various embodiments, overcap 20 is configured such that rotation of the overcap 20 only causes rotation of the cap 80 when the interface portion of the overcap 20 interfaces with the interface portion of the cap 80.

Top panel 52 of liner 50 extends distance 58 above central portion 54 of liner 50. Biasing element 74 maintains top panel 52 to be distance 58 above central portion 54, except when a force is exerted on overcap 20 and/or liner 50 to open closure 10 (described in more detail below).

Top panel 22 of overcap 20 extends height 28 above central portion 24 of overcap 20. Overcap 20 includes a retaining feature, shown as ledge 30, which extend from cylindrical wall 34 inwardly towards axis 8. As will be described in more detail below, ledge 30 interfaces against a bottom of knurls 90 to secure overcap 20 to cap 80.

Figure 7:
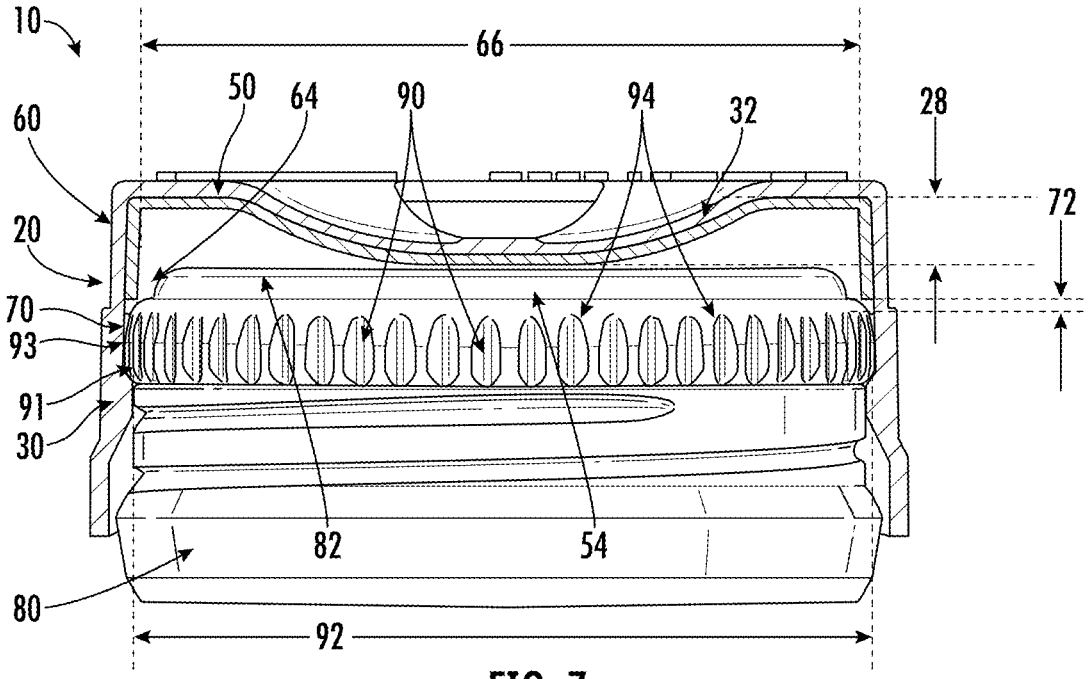
FIG. 7 is a cross-sectional view of the overcap and liner portion of the closure of FIG. 5 taken along the line A-A in FIG. 5, shown transposed with a side view of the cap portion of the closure of FIG. 1.
Figure 8:
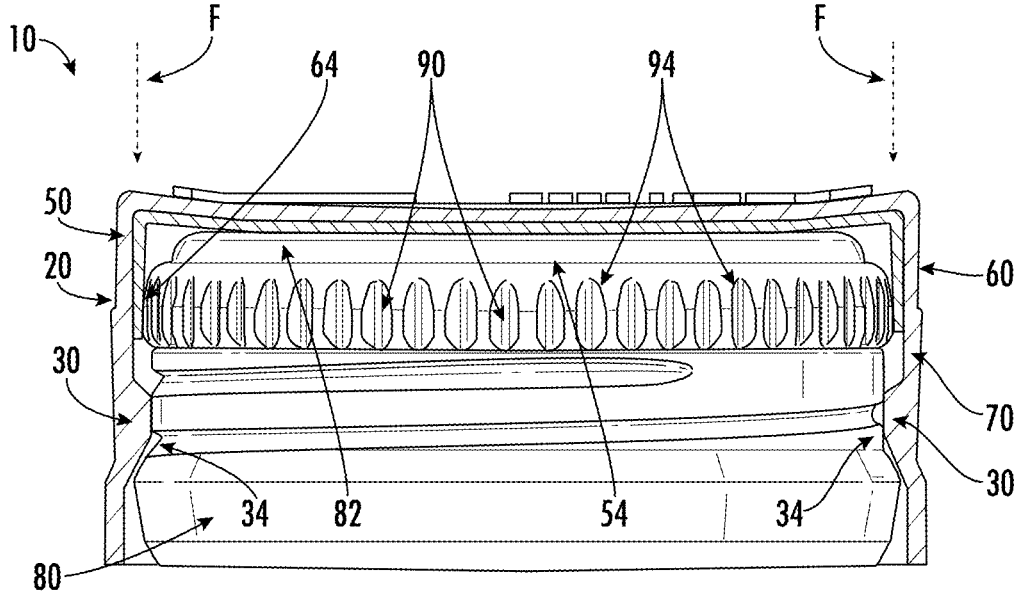
FIG. 8 is a cross-sectional view of the overcap and liner portion of the closure of FIG. 5 taken along the line A-A in FIG. 5, shown transposed with a side view of the cap portion of the closure of FIG. 1, shown in a different position than depicted in FIG. 7.

Turning to FIGS. 7-8, various configurations of closure 10 are shown. In FIG. 7, overcap 20 and liner 50 are coupled to and around cap 80. In FIG. 7, rotation of liner 50 translates to a relatively lower amount of torque (compared to FIG. 8) being exerted on cap 80 because of their limited interface in this positioning. In the position depicted in FIG. 7, bottom edge 70 of cylindrical wall 60 of liner 50 is distance 72 above top 94 of knurls 90 because arms 32 bias interface portion 64 of overcap 20 distance 72 from (e.g., above) knurls 90 of cap 80.

Turning to FIG. 8, to remove cap 80 from a container neck, a user pushes overcap 20 and liner 50 in direction F until interfacing portion 64 of liner 50 is interfacing against knurls 90 of cap 80 (e.g., until bottom edge 70 of cylindrical wall 60 of liner 50 is below top 94 of knurls 90). Liner 50 and knurls 90 interface in this positioning because the diameter 92 of knurls 90 is greater than the diameter 66 of liner 50. As a result, in this position rotation of liner 50 produces an increased amount of torque to cap 80 compared to the configuration in FIG. 7 via the interface between interfacing portion 64 of liner 50 and knurls 90, and via the interface between central portion 54 of liner 50 and top panel 82 of cap 80.

Ledge 30 of overcap 20 interfaces with knurls 90 to resist overcap 20 being removed from cap 80. According to one method of producing closure 10, overcap 20 and liner 50 are placed on and around cap 80 via overcap 20 deforming to permit ledge 30 to transit past knurls 90 until ledge 30 are between knurls 90 and the container body.

Figure 9:
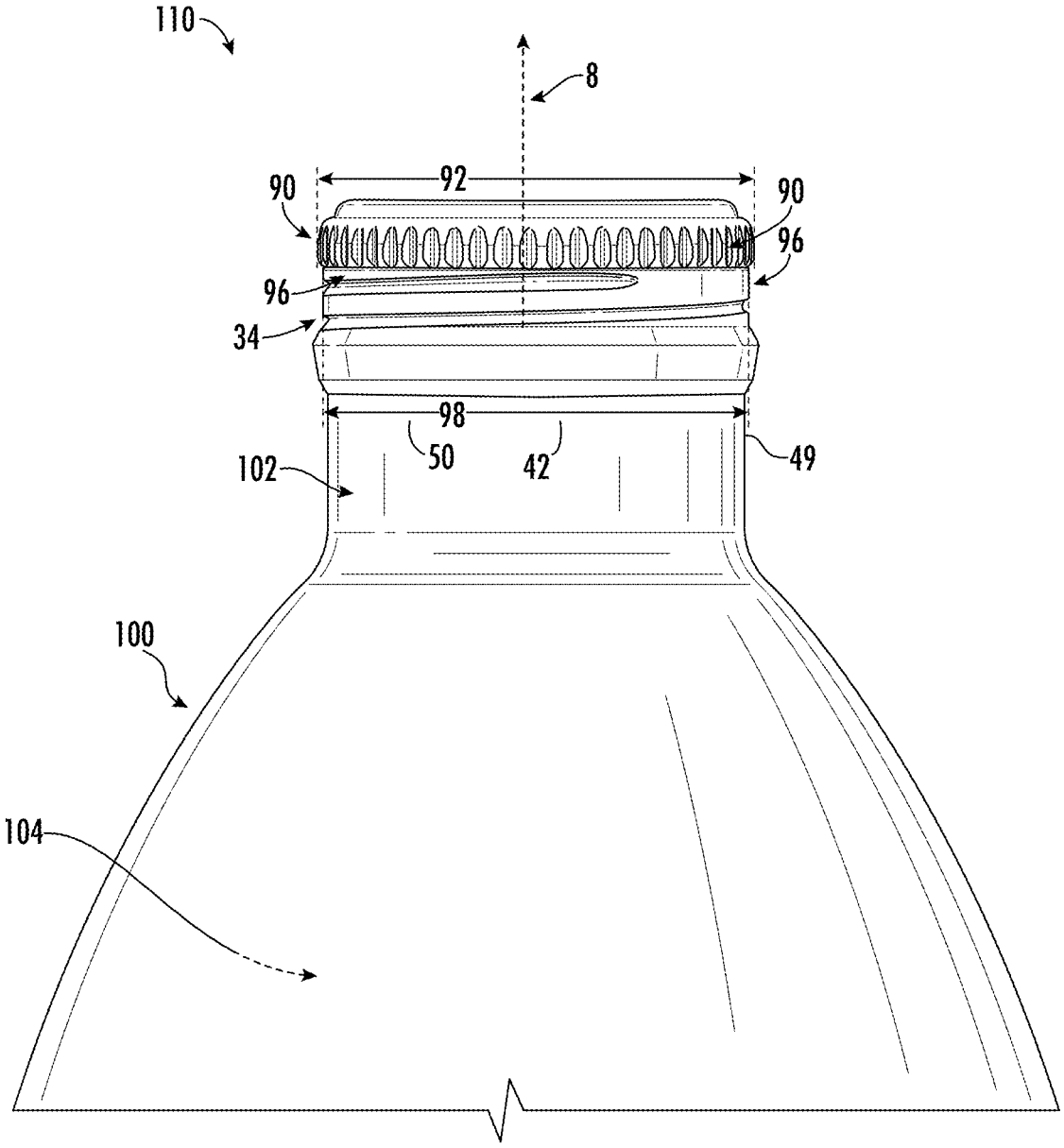
FIG. 9 is a side view of the closure of FIG. 1 coupled to a container.

Referring to FIG. 9, various aspects of closure combination 110 are shown. In various embodiments, closure combination 110 includes container 100 and closure 10, and closure 10 is coupled to container 100. Container 100 includes container neck 102 that defines an opening for container 100. The opening provides fluid communication between internal volume 104 of container 100 and an exterior of container 100. The container neck 102 is centered around axis 8. Closure 10 is coupled to the container neck 102, such as by cap 80 being rolled on to the container neck 102.

Figure 10:
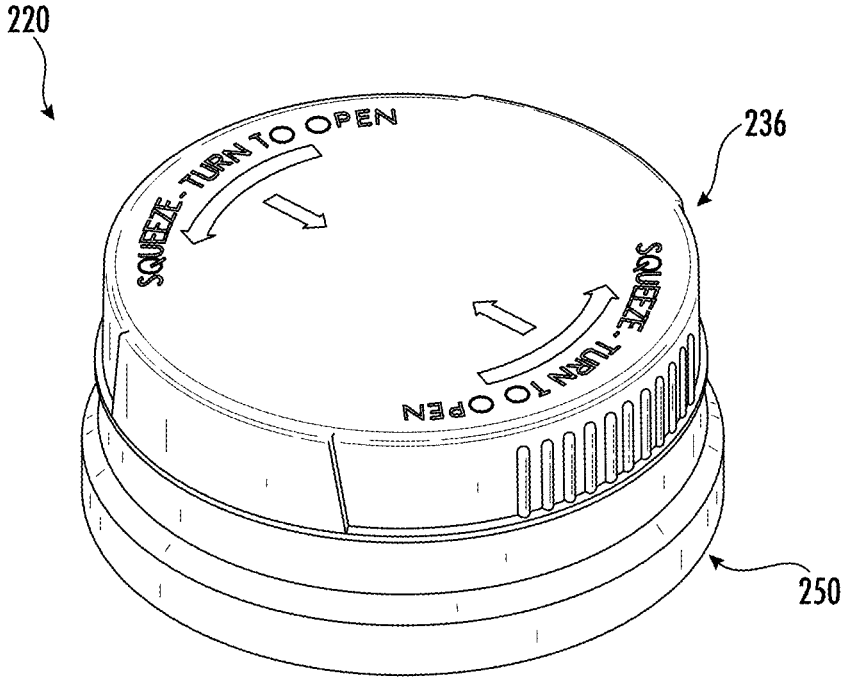
FIG. 10 is a perspective view of an overcap, according to an embodiment.
Figure 11:
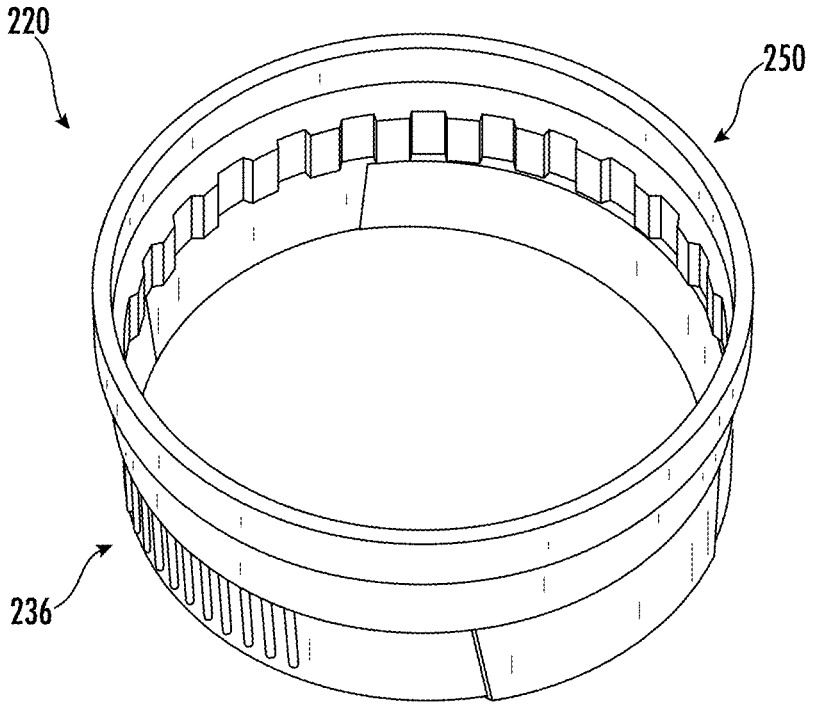
FIG. 11 is a perspective view of the overcap of FIG. 10, according to an embodiment.
Figure 12:
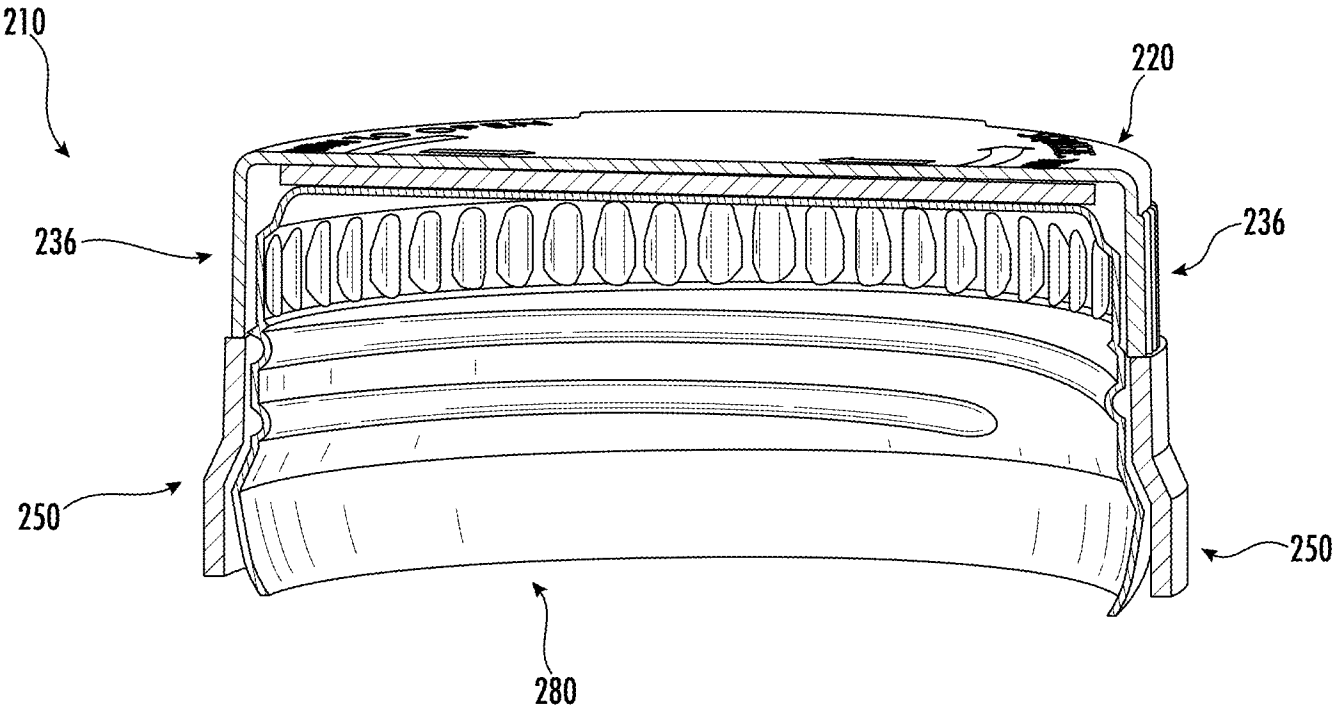
FIG. 12 is a cross-section view of a closure including a cap and the overcap of FIG. 10, according to an embodiment.
Figure 13:
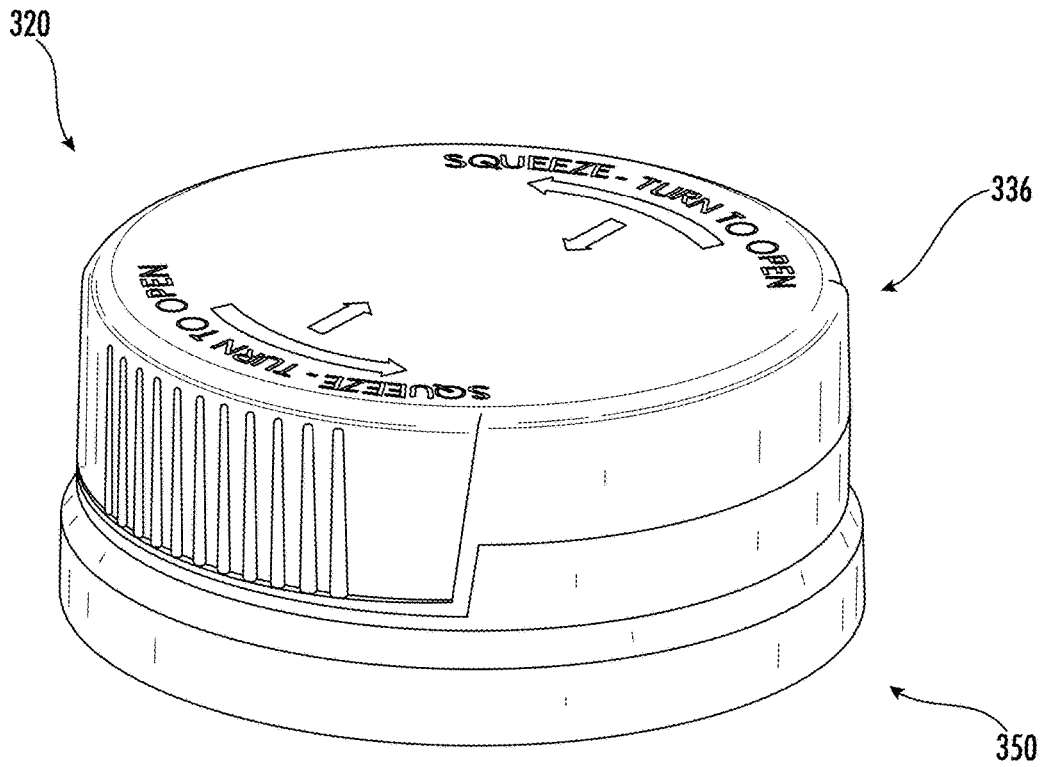
FIG. 13 is a perspective view of an overcap, according to an embodiment.
Figure 14:
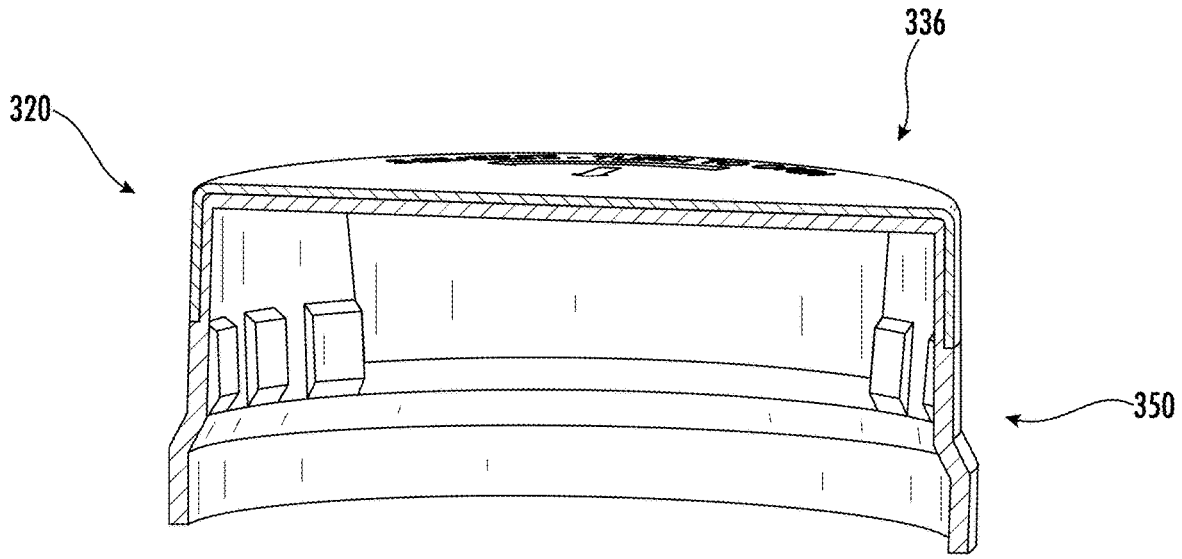
FIG. 14 is a cross-section view of the overcap of FIG. 13, according to an embodiment.
Figure 15:
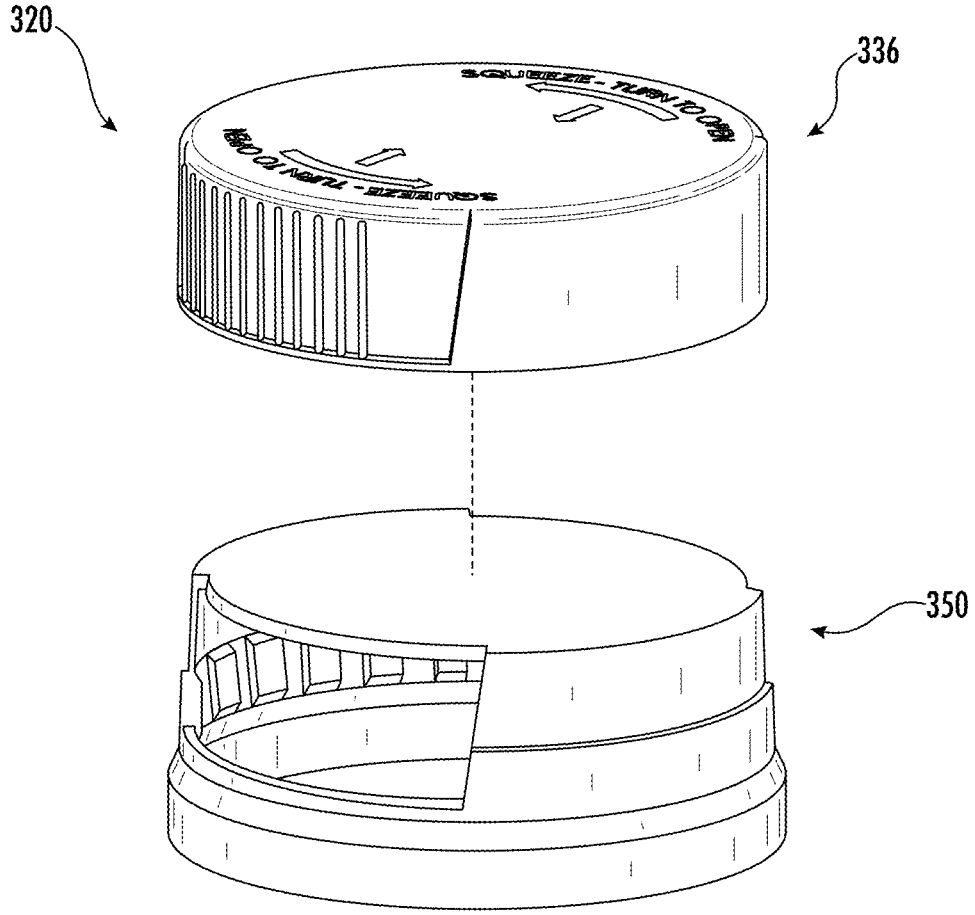
FIG. 15 is an exploded view of the overcap of FIG. 13, according to an embodiment.
Figure 16:
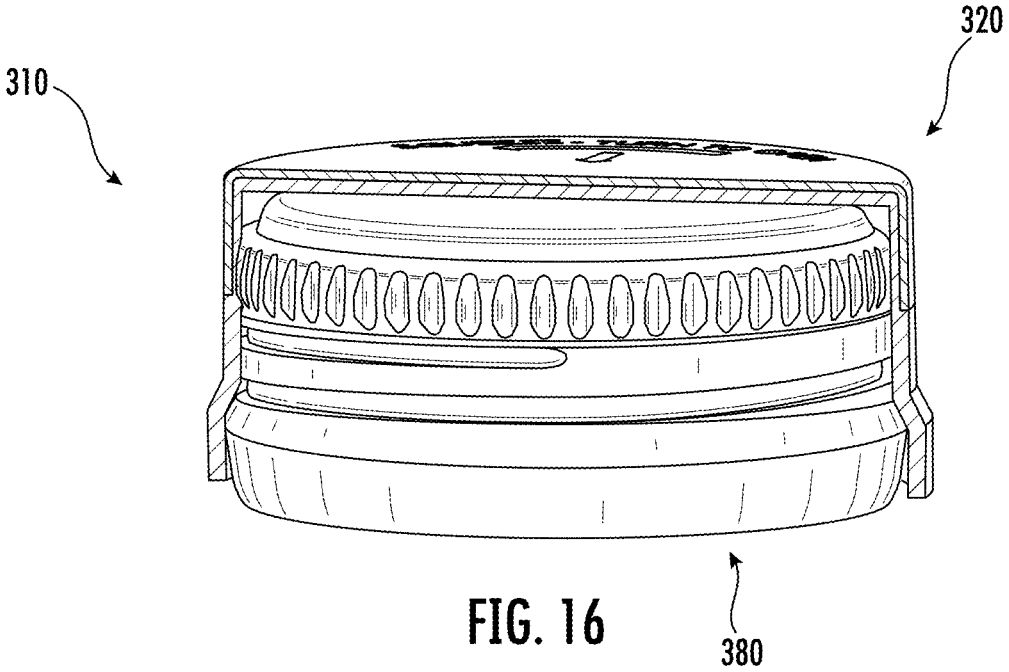
FIG. 16 is a perspective view of a closure including a cap and a cross-section of the overcap of FIG. 13, according to an embodiment.

Referring to FIGS. 10-12, various aspects of closure 210 are shown. Closure 210, and in particular overcap 220, are substantially the same as closure 10 and overcap 20, respectively, except for the differences discussed herein. In particular, liner 250 and outer portion 236 of overcap 220 have larger diameters than cap 280. Thus, to twist cap 280 via overcap 220, a user pushes the sides of overcap 220 in towards a center of closure 210 until liner 250 and/or outer portion 236 interface with cap 280. When the overcap 220 is squeezed against cap 280 with sufficient force (e.g., to overcome the static friction between cap 280 and the container that the cap 280 is affixed to), the user rotates overcap 220 and cap 280 is correspondingly also rotated.

Referring to FIG. 11, liner 250 includes one or more apertures in a sidewall of liner 250, thereby enabling outer portion 236 to selectively engage with cap 280 when overcap 220 is squeezed together by a user. In a specific embodiment, liner 250 includes two such apertures. In a specific embodiment, each aperture extends between 70-110 degrees circumferentially around liner 350, and more specifically 80-100 degrees, and more specifically, 90 degrees.

In a specific embodiment, a container combination includes a container and closure 210 affixed to the container. The closure 210 includes the overcap 220 and the cap 280. To rotate cap 280 from the container, the user squeezes overcap 220 until overcap 220 interfaces with cap 280 with sufficient force to permit the user to rotate cap 280. In a specific embodiment, when the user squeezes overcap 220, liner 250 interfaces with cap 280 and outer portion 236 does not. In a specific embodiment, when the user squeezes overcap 220, outer portion 336 interfaces with cap 380 and liner 350 does not. In a specific embodiment, when the user squeezes overcap 220, both outer portion 336 and liner 350 interface with cap 380.

Referring to FIGS. 13-16, various aspects of closure 310 are shown. Closure 310, and in particular overcap 320, are substantially the same as closure 10 and overcap 20, respectively, except for the differences discussed herein. In particular, liner 350 and outer portion 336 of overcap 320 have larger diameters than cap 380. Thus, to twist cap 380 via overcap 320, a user pushes the sides of overcap 320 in towards a center of closure 310 until liner 350 and/or outer portion 336 interface with cap 380. When the overcap 320 is squeezed against cap 380 with sufficient force, the user rotates overcap 320 and cap 380 is correspondingly also rotated.

Figure 17:
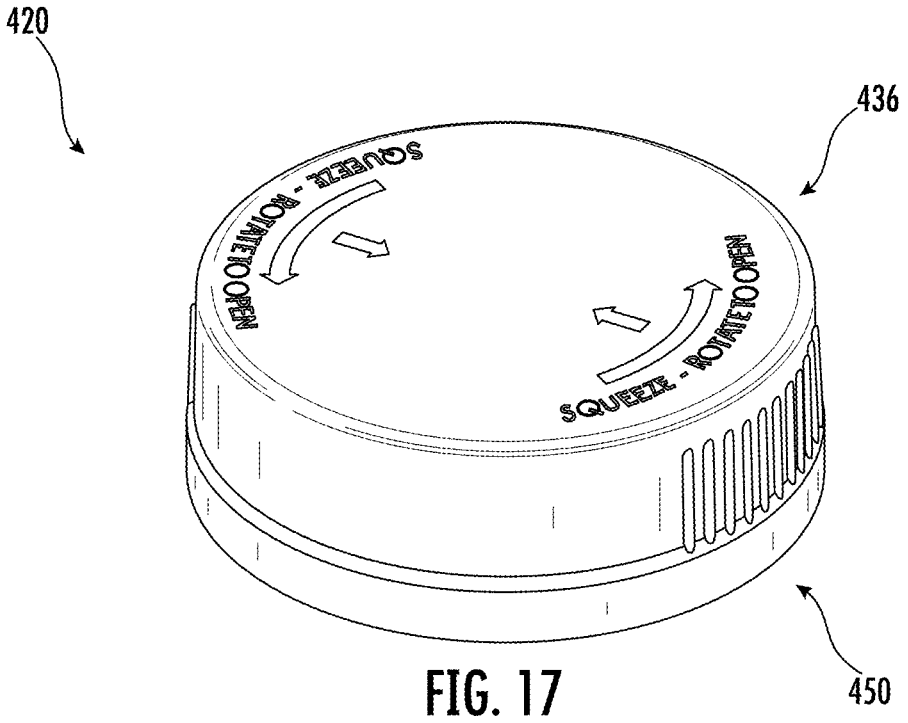
FIG. 17 is a perspective view of an overcap, according to an embodiment.
Figure 18:
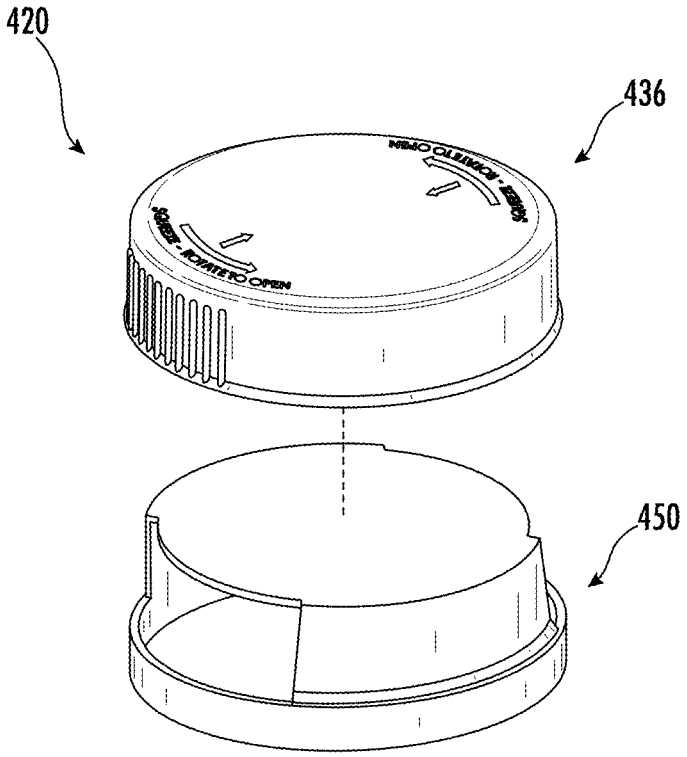
FIG. 18 is an exploded view of the overcap of FIG. 17, according to an embodiment.
Figure 19:
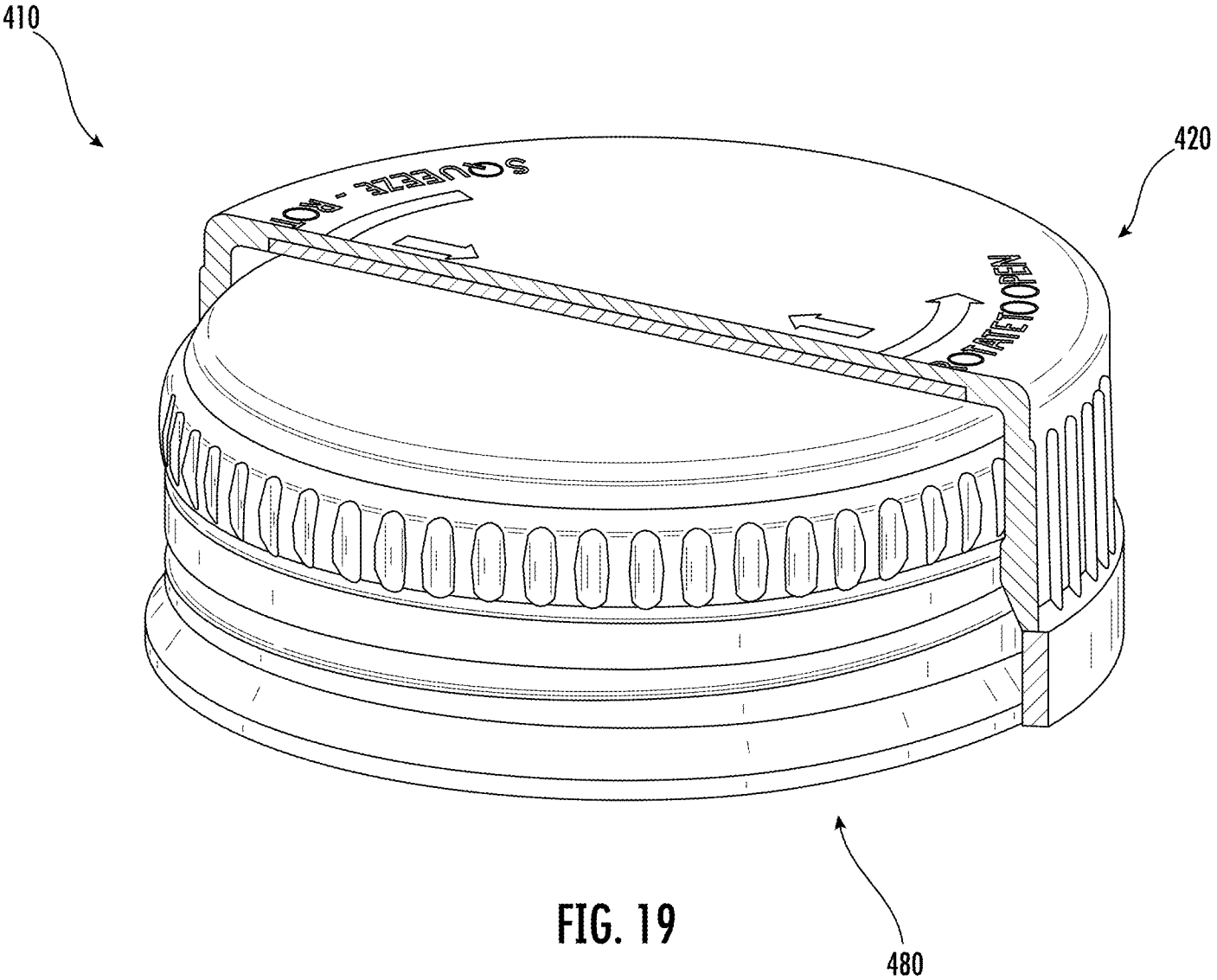
FIG. 19 is a perspective view of a closure including a cap and a cross-section of the overcap of FIG. 17, according to an embodiment.

Referring to FIGS. 17-19, various aspects of closure 410 are shown. Closure 410, and in particular overcap 420, are substantially the same as closure 10 and overcap 20, respectively, except for the differences discussed herein. In particular, liner 450 and outer portion 436 of overcap 420 have larger diameters than cap 480. Thus, to twist cap 480 via overcap 420, a user pushes the sides of overcap 420 in towards a center of closure 410 until liner 450 and/or outer portion 436 interface with cap 480. When the overcap 420 is squeezed against cap 480 with sufficient force, the user rotates overcap 420 and cap 480 is correspondingly also rotated.

Figure 20:
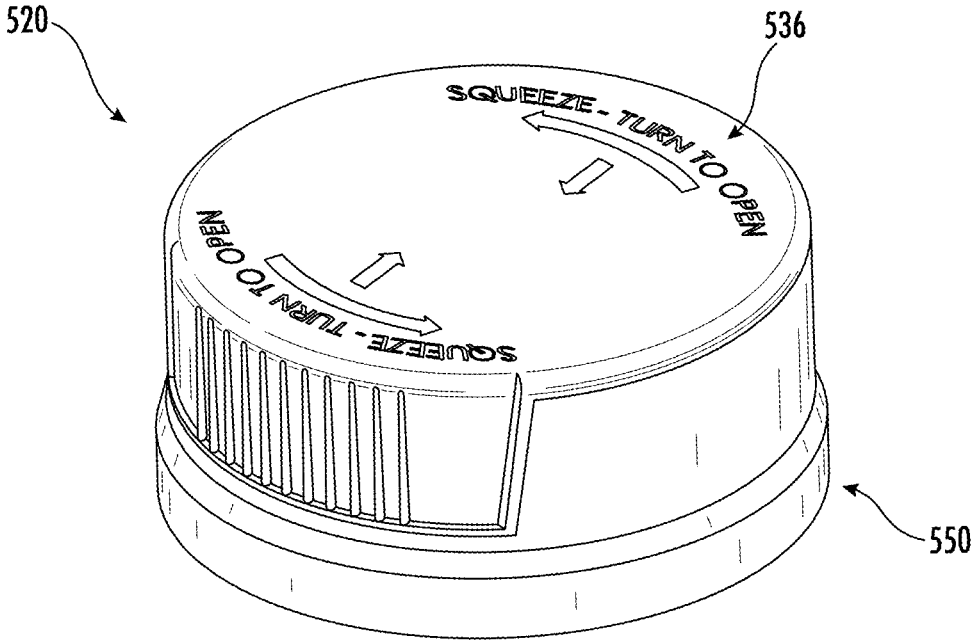
FIG. 20 is a perspective view of an overcap, according to an embodiment.
Figure 21:
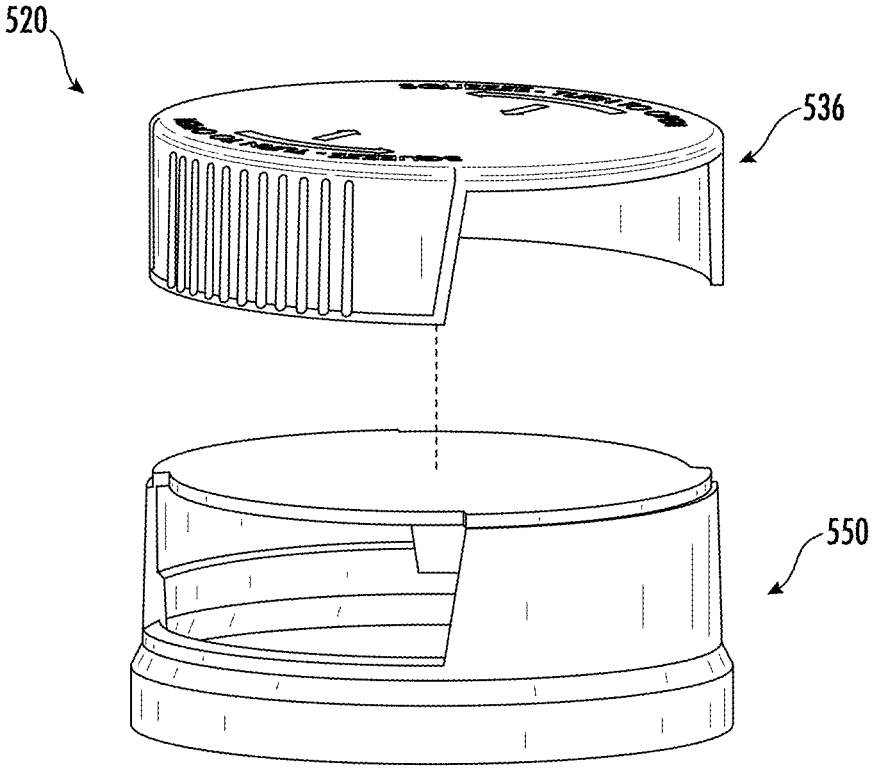
FIG. 21 is an exploded view of the overcap of FIG. 20, according to an embodiment.
Figure 22:
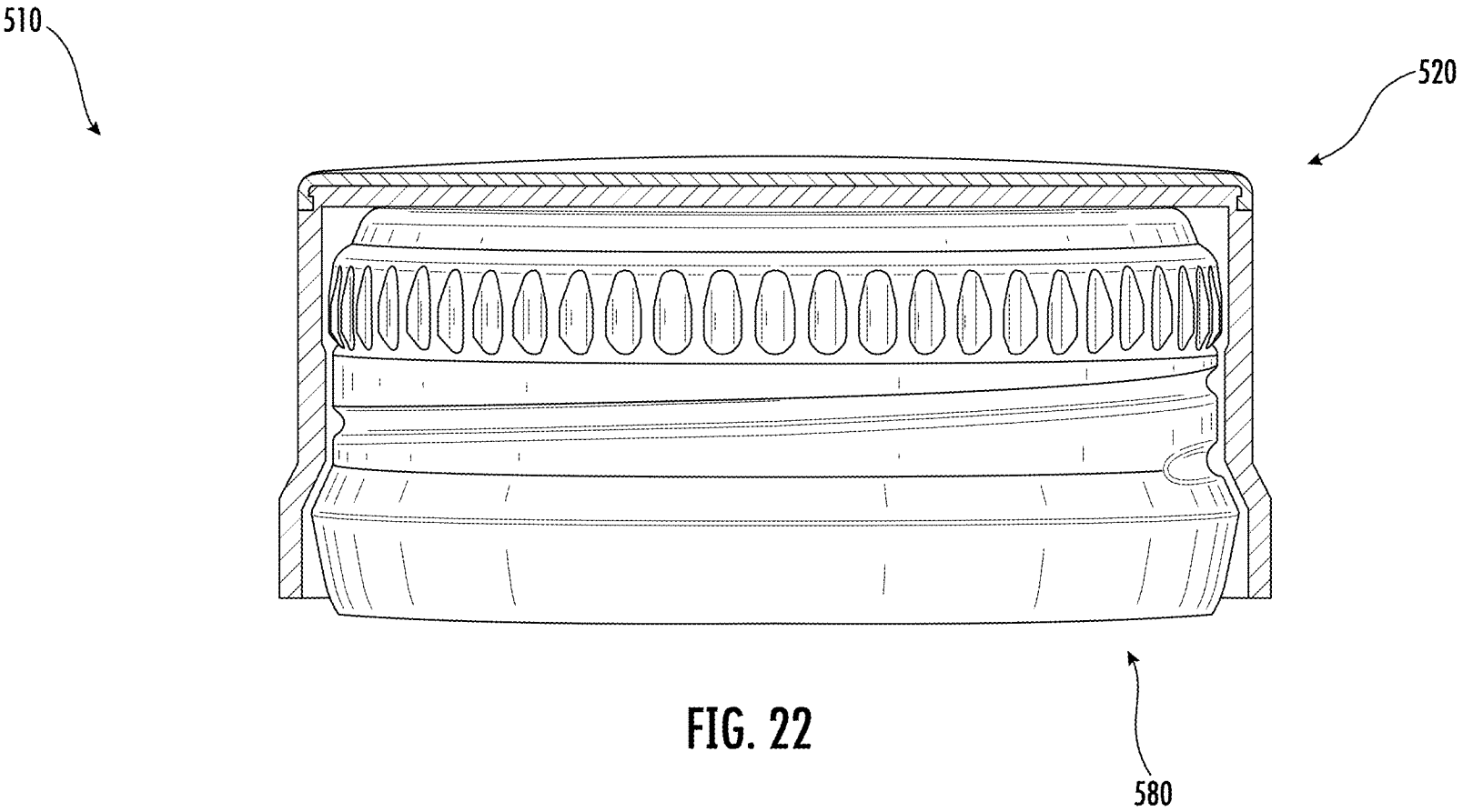
FIG. 22 is a side view of a closure including a cap and a cross-section of the overcap of FIG. 20, according to an embodiment.

Referring to FIGS. 20-22, various aspects of closure 510 are shown. Closure 510, and in particular overcap 520, are substantially the same as closure 10 and overcap 20, respectively, except for the differences discussed herein. In particular, liner 550 and outer portion 536 of overcap 520 have larger diameters than cap 580. Thus, to twist cap 580 via overcap 520, a user pushes the sides of overcap 520 in towards a center of closure 510 until liner 550 and/or outer portion 536 interface with cap 580. When the overcap 520 is squeezed against cap 580 with sufficient force, the user rotates overcap 520 and cap 580 is correspondingly also rotated.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A closure comprising:

a cap comprising:

a top panel;

a vertical axis around which the top panel is centered;

a cylindrical wall that extends from the top panel, the cylindrical wall defining an inner surface that faces towards the vertical axis and an opposing outer surface that faces away from the vertical axis;

an interface portion of the outer surface; and a first diameter of the interface portion with respect to the vertical axis, the first diameter is a maximum diameter of the interface portion; and an overcap configured to be placed over the cap, the overcap comprising:

a top panel;

a cylindrical wall extending from an outer periphery of the top panel, the cylindrical wall defining an inner surface that faces towards the vertical axis;

an interface portion of the inner surface, the interface portion of the overcap is configured to selectively interface with the interface portion of the cap;

a second diameter of the interface portion with respect to the vertical axis, wherein the second diameter is less than the first diameter; and an arm that biases the interface portion of the overcap a distance from the interface portion of the cap.

2. The closure of claim 1, wherein the cap is formed from a material that includes aluminum.

3. The closure of claim 1, the interface portion of the cap comprising a plurality of protrusions that extend radially away from the vertical axis.

4. The closure of claim 3, each of the plurality of protrusions extending along a primary longitudinal axis that is parallel to the vertical axis.

5. The closure of claim 4, the overcap comprising a ledge that extends inwardly towards the vertical axis, the ledge interfacing against a lower end of the plurality of protrusions to secure the overcap to the cap.

6. The closure of claim 1, the overcap comprising an outer portion and an inner portion coupled to the outer portion, the inner portion of the overcap comprising the interface portion that interfaces with the interface portion of the cap.

7. The closure of claim 6, wherein the outer portion and the inner portion are formed from different materials.

8. The closure of claim 7, the overcap comprising a central portion that interfaces against the top panel of the cap.

9. The closure of claim 6, wherein the outer portion of the overcap comprises a central portion that the vertical axis extends through.

10. The closure of claim 9, wherein the inner portion of the overcap comprises a central portion that the vertical axis extends through.

11. A closure combination comprising:
- a container comprising:
  - an internal volume of the container;
  - a container neck that defines an opening, the opening provides fluid communication between the internal volume of the container and an exterior of the container; and
  - a vertical axis around which the container neck is centered;
- a cap comprising:
  - a top panel;
  - a cylindrical wall that extends from the top panel, the cylindrical wall defining an inner surface that faces towards the vertical axis and an opposing outer surface that faces away from the vertical axis;
  - an interface portion of the outer surface; and
  - a first diameter of the interface portion with respect to the vertical axis, the first diameter is a maximum diameter of the interface portion; and
- an overcap configured to be placed over the cap, the overcap comprising:
  - a top panel;
  - a cylindrical wall extending from an outer periphery of the top panel, the cylindrical wall defining an inner surface that faces towards the vertical axis;
  - an interface portion of the inner surface, the interface portion of the overcap is configured to selectively interface with the interface portion of the cap;
  - a second diameter of the interface portion, wherein the second diameter is less than the first diameter; and
  - an arm that biases the interface portion of the overcap away from the interface portion of the cap.

12. The combination of claim 11, the interface portion of the cap comprising a plurality of protrusions that extend radially away from the vertical axis and each of the plurality of protrusions extending along a primary longitudinal axis that is parallel to the vertical axis.

13. The combination of claim 12, the overcap comprising a ledge that extends inwardly towards the vertical axis, the ledge interfacing with a lower end of the plurality of protrusions to secure the overcap to the cap.

14. The combination of claim 11, the overcap comprising an outer portion and an inner portion coupled to the outer portion, the inner portion of the overcap comprising the interface portion that interfaces with the interface portion of the cap.

15. The combination of claim 14, wherein the outer portion of the overcap comprises a circular central portion that the vertical axis extends through, and wherein the inner portion of the overcap comprises a circular central portion that the vertical axis extends through.

16. A closure comprising:
- a cap comprising:
  - a top panel;
  - a vertical axis around which the top panel is centered;
  - a cylindrical wall that extends from the top panel, the cylindrical wall defining an inner surface that faces towards the vertical axis and an opposing outer surface that faces away from the vertical axis; and
  - an interface portion; and
- an overcap comprising:
  - a top panel;
  - a cylindrical wall extending from an outer periphery of the top panel, the cylindrical wall defining an inner surface that faces towards the vertical axis;
  - an interface portion, the interface portion of the overcap is configured to selectively interface with the interface portion of the cap; and
  - an arm that biases the interface portion of the overcap away from the interface portion of the cap, wherein the overcap is configured such that rotation of the overcap only causes rotation of the cap when the interface portion of the overcap interfaces with the interface portion of the cap.

17. The closure of claim 16, wherein the outer surface of the cap comprises the interface portion of the cap.

18. The closure of claim 17, the interface portion of the cap defining a first diameter that is a maximum diameter of the interface portion, the interface portion of the overcap defining a second diameter that is less than the first diameter.

19. The closure of claim 16, the interface portion of the cap comprising a plurality of protrusions extending along a primary longitudinal axis that is parallel to the vertical axis.

20. The closure of claim 16, the overcap comprising an outer portion and an inner portion coupled to the outer portion, the inner portion of the overcap comprising the interface portion that interfaces with the interface portion of the cap, wherein the outer portion and the inner portion are formed from different materials.

* * * * *